US006076379A

United States Patent [19]

Grandpierre

[11] Patent Number: 6,076,379

[45] Date of Patent: Jun. 20, 2000

[54] TUNNEL WASHING MACHINE WITH LATERAL CLOTHES TRANSFER

[75] Inventor: Cyril Grandpierre, Troyes, France

[73] Assignee: Electrolux Systemes de Blanchisserie, Rosieres, France

[21] Appl. No.: 09/202,458

[22] PCT Filed: Apr. 23, 1998

[86] PCT No.: PCT/FR98/00812

§ 371 Date: Dec. 15, 1998

§ 102(e) Date: Dec. 15, 1998

[87] PCT Pub. No.: WO98/48094

PCT Pub. Date: Oct. 29, 1998

[30] Foreign Application Priority Data

Apr. 24, 1997 [FR] France ..... 97 05076

[51] Int. Cl.[7] ..... D06F 31/00

[52] U.S. Cl. ..... 68/27; 68/143

[58] Field of Search ..... 68/27, 58, 143, 68/145; 134/65

[56] References Cited

U.S. PATENT DOCUMENTS

| | | | |
|---|---|---|---|
| 3,878,699 | 4/1975 | Steinort | 68/145 |
| 5,307,652 | 5/1994 | Hagiwara et al. | 68/145 X |

FOREIGN PATENT DOCUMENTS

| | | | |
|---|---|---|---|
| 1 948 045 | 9/1969 | Germany . | |
| 2156205 | 5/1973 | Germany | 68/143 |
| 23 52 717 | 10/1973 | Germany . | |
| 2235599 | 1/1974 | Germany | 68/143 |
| 2 312 003 | 1/1975 | Germany . | |
| 2912183 | 10/1980 | Germany | 68/145 |
| 609112 | 2/1979 | Switzerland | 68/145 |
| 1 501 652 | 1/1975 | United Kingdom . | |

*Primary Examiner*—Philip R. Coe
*Attorney, Agent, or Firm*—Pearne & Gordon LLP

[57] ABSTRACT

Washing tunnel comprising a drum (16) with a horizontal axis, partitioned lengthwise to form successive adjacent compartments between which loads of laundry are transferred while undergoing prewash, washing and rinsing operations. The partitioning is achieved by means of partitions (30) the upper parts of which are pierced to create openings (32) that have the shape of circular sectors. Each compartment contains a blade (34) that transfers the laundry when the drum (16) makes a complete revolution. The blade (34) joins the opposing sides of the openings (32). It is formed of at least three more or less flat sections (36, 38) assembled using straight or circular welds. Automated production is therefore possible.

10 Claims, 5 Drawing Sheets

TUNNEL WASHING MACHINE WITH LATERAL CLOTHES TRANSFER

DESCRIPTION

1. Field of the Invention

The present invention relates to a washing tunnel designed simultaneously to carry out prewash, washing and rinsing operations in different compartments on loads of laundry present in said compartments.

This type of installation may be used in all cases where it is necessary to wash large quantities of laundry rapidly and efficiently. Non-limitative examples of applications of the invention might be for use in hospitals and large laundries.

2. Background Art

Washing tunnels are large installations that comprise a drum with a horizontal axis placed in a fixed tank. The drum is divided lengthwise into successive compartments each of which is capable of containing a load of laundry. Loads of laundry for washing are inserted at one end of the tunnel and removed at the other end when washing is complete. Each load therefore passes successively through one or more prewash compartments, at least two washing compartments and one or more rinsing compartments before leaving the tunnel.

In order to agitate the laundry sufficiently to complete the required prewash, washing and rinsing operations the drum is subjected to alternate rotating movements around its axis; these movements are normally of the order of 270°. The loads of laundry, on the other hand, are simultaneously transferred from one compartment to the next each time the drum rotates fully around its axis.

The functions of separating the compartments when the alternate rotation of the drum is only 270° and of transferring loads from one compartment to the next when the drum makes a complete revolution are ensured by the partitions separating the compartments inside the drum. Two partitioning techniques are currently in use.

In the first known technique, called "bottom transfer", the drum is divided up by a helicoidal partition or Archimedes screw. The alternating rotary movement has the effect of keeping the loads of laundry in compartments separated from one another by the helicoidal partition. The separation is also maintained when the drum makes a complete turn to move the laundry from one compartment to the next inside the tunnel.

This first known technique for partitioning the drum of washing tunnels has the advantage of there being no possibility of laundry getting jammed between adjacent compartments. In the event of two loads accidentally falling into the inlet compartment the loads are transferred without being damaged to the outlet end of the tunnel; there is no risk of jamming making it necessary to shut down the washing operation.

This type of washing tunnel also has the advantage that for a given drum diameter the distance laundry drops during agitation is relatively great. This dropping height uses approximately ⅔ of the diameter of the drum. This characteristic is important as it determines the mechanical work to which the laundry is subjected; this in turn affects the quality of the wash.

On the negative side, however, washing tunnels comprising an Archimedes screw have the drawback of being particularly expensive. The helicoidal partition cannot be fabricated out of a single piece of sheet metal and therefore production cannot be automated.

Furthermore, these tunnels transfer all the water they contain together with the laundry when the drum makes a complete revolution to move laundry into the next compartment.

The second technique in current use is called "center transfer" and consists in separating successive compartments by means of radial partitions. In this system each partition is provided with a circular central opening to which is connected a transfer structure that has the approximate shape of a scoop located in one of the adjacent compartments. When the drum makes a complete revolution the scoop structure lifts the laundry and passes it through the central opening.

Compared with washing tunnels using the Archimedes screw type of partitioning this technique has the advantage of being suitable for automated production. The majority of the sheet metal used to construct the partition is flat, most seams are at right angles and welds are generally straight or circular. Consequently washing tunnels using this partitioning technique are appreciably less expensive than those using the Archimedes screw.

Moreover, the scoop structures used to transfer the laundry from one compartment to the next each time the drum makes a complete revolution are usually perforated. This characteristic makes it possible to avoid transferring all the water contained in the laundry from one compartment to the next. The quality of the wash is thus improved.

On the other hand, if two loads of laundry are accidentally loaded into the same compartment clogging leading to complete jamming of the laundry is inevitable when laundry loads are transferred between adjacent compartments; this is because transfer is via narrow passages that constitute bottlenecks between adjacent compartments. When this occurs the machine must be shut down and some considerable time devoted to clearing the jam. This is a serious drawback to this technique, given the large quantities of laundry normally handled each day by washing tunnels.

Furthermore, washing tunnels in which loads are transferred from one compartment to the next by means of scoop structures are characterized by a noticeably reduced dropping height for the same tunnel diameter compared with that of the Archimedes screw type machine since the transfer scoop takes up significant space inside the drum. Consequently, to subject the laundry to the same mechanical work a larger-diameter drum must be used.

DISCLOSURE OF THE INVENTION

The invention specifically relates to a washing tunnel that has an original partitioning system that enables it to combine the advantages of Archimedes screw type machines with those of machines in which the transfer is effected via the center by means of scoops fitted to the side of the drum.

More precisely, the invention relates to a washing tunnel whose partitioning is suitable for automated production, thereby reducing costs, that allows water to drain off during transfer of laundry, that avoids the risk of jamming when two loads of laundry are accidentally loaded into the same compartment and that has a laundry dropping height of approximately two-thirds of the diameter of the drum, thereby giving optimal washing quality for a given drum diameter.

According to the invention this result is obtained by means of a washing tunnel that comprises a drum that is mounted so that it rotates on a more or less horizontal axis and that has a first end into which the soiled laundry is inserted and a second end from which the clean laundry is removed, partitions dividing the drum into a plurality of successive compartments located between the first and second end for carrying out prewashing, washing and rinsing operations, each partition comprising an off-center opening formed between the axis and the circumferential wall of the drum, a transfer blade being located in each compartment between the openings so as to ensure the automatic transfer of the laundry between the compartments during a complete revolution of the drum, characterized by the fact that the off-center openings are oriented upwards in a median position of the drum during agitation of the laundry caused by alternate rotation of the drum by less than one turn, said transfer blades and partitions being constructed from more or less flat components.

This arrangement ensures that loads of laundry are transferred by action of the sides of the drum when the drum makes a complete revolution. It also simplifies production and reduces costs.

Advantageously each transfer blade has more or less the shape of part of a helix.

In a preferred embodiment of the invention each partition is oriented radially in relation to the axis of the drum and the opening has more or less the shape of a circular sector cut into the partition.

Preferably the circular sector formed by the opening has an angle that is noticeably offset from the axis on the opening side, i.e. towards the top when the drum is in the median position.

Each transfer blade therefore connects opposite sides of circular sectors cut into the partitions that define the compartment containing the blade.

In a first embodiment of the invention each transfer blade comprises a more or less flat intermediate section in the shape of a circular sector that has an edge that is an arc of a circle connected to the circumferential wall of the drum and connecting two consecutive partitions, and two straight edges that are more or less aligned with the opposing sides of the circular sectors formed by the openings, parallel to the said axis, i.e. when the drum is viewed from the end. Each transfer blade also comprises two triangular end-pieces that are more or less flat. These end-pieces connect the straight edges of the intermediate section to the opposing sides of the circular sectors formed by the openings that give into the compartment in question.

In the preferred embodiment of the invention the two triangular end-pieces are replaced by two end- pieces each of which is formed by at least two more or less triangular, non-coplanar flat components that connect the straight edges of the intermediate section to the opposing sides of the circular sectors formed by the openings that give into the compartment in which the blade is housed.

Moreover, the transfer blades are advantageously perforated to allow some of the water contained in the laundry to drain off when the laundry is transferred from one compartment to another.

BRIEF DESCRIPTION OF THE DRAWINGS

Two non-limitative examples of embodiments of the invention will now be described with reference to the attached figures where.

DETAILED DISCLOSURE OF EMBODIMENTS

Figure 1:
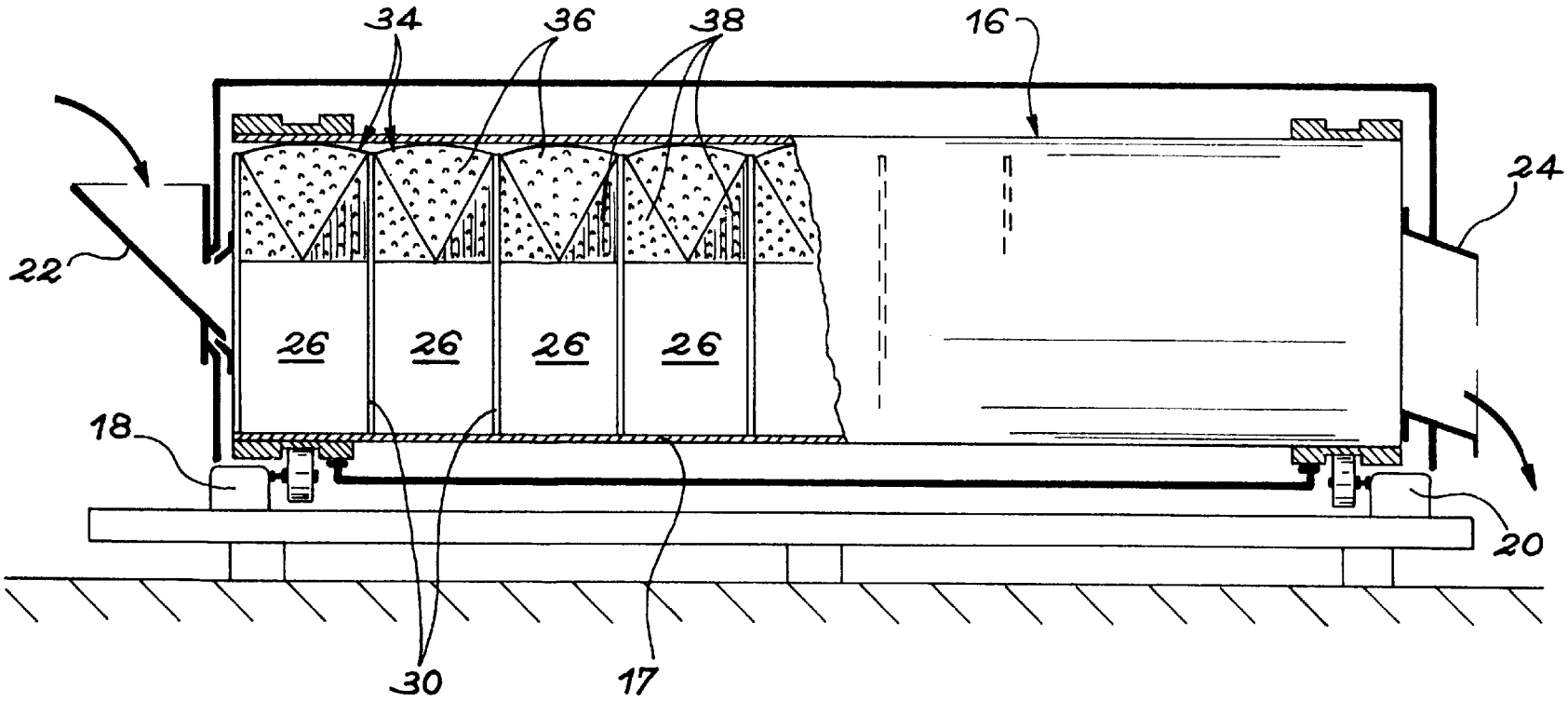
FIG. 1 is a side view of a partial longitudinal section showing a schematic representation of a washing tunnel according to the invention.

As can be seen in schematic form in FIG. 1, the washing tunnel of the invention comprises a cylindrical drum 16 mounted so that it can rotate around a horizontal axis. Drum 16 has a circumferential wall 17 that is normally perforated together with end walls each of which is fitted with a circular central opening (not shown).

FIG. 1 also includes schematic representations of geared motors 18 and 20 that are capable of causing drum 16 to make alternate rotations of approximately 270° around its axis on either side of a median position illustrated in the figures, as well as a complete revolution of the drum to transfer the loads from one compartment to the next.

It is clear that the action of the geared motors that causes the drum to make both partial alternate and complete revolutions may be provided by a single geared motor without leaving the framework of the invention.

FIG. 1 also includes a schematic representation of hopper 22 used to introduce soiled laundry at a first end of the washing tunnel together with an outlet chute used to remove laundry automatically from the other end of the tunnel. Hopper 22 and chute 24 open into drum 16 via the above-mentioned openings (not shown) in the end walls of the drum.

According to the invention, partition walls of an original design (see detailed description below) divide the inside of the drum into a certain number of successive compartments 26 between the end at which the soiled laundry is introduced via hopper 22 and the outlet end at which the clean laundry is removed via chute 24. All the compartments 26 are of generally identical volume and are used to perform one operation to which the laundry introduced into the tunnel is to be subjected. More precisely, as the laundry moves from the input end to the output end of the tunnel it passes successively through at least one prewash compartment, at least two washing compartments and at least one rinsing compartment. The number of compartments 26 dedicated to each operation varies according to user requirements such that the total number of compartments 26 increases as the quality and quantity of the wash is increased.

To make FIG. 1 easier to read a certain number of standard components are not shown. Among these components are means for ensuring the circulation of water in the prewash, washing and rinsing compartment or compartments as well as leaktightness systems provided to guarantee the separation between the various compartments 26.

Figure 4:
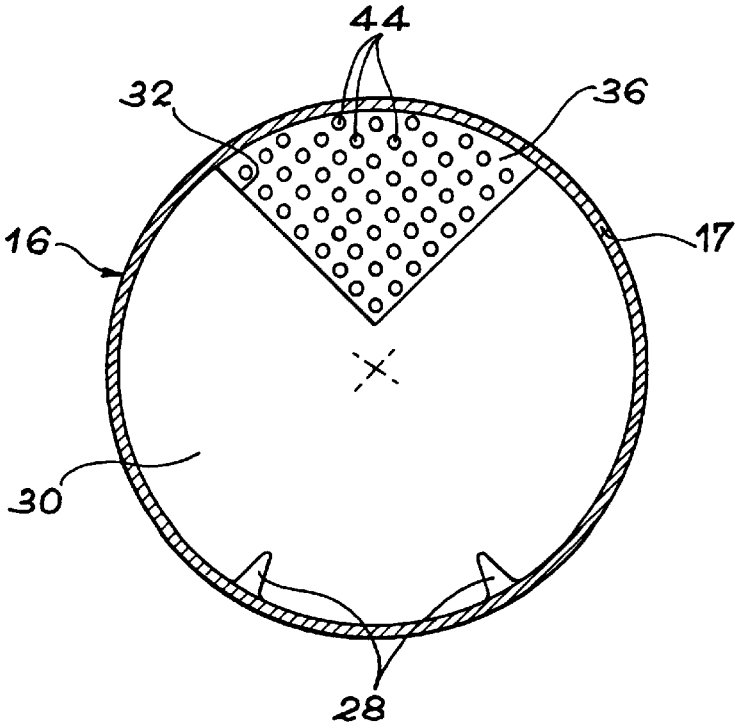
FIG. 4 is an end view of the partitioning shown in FIGS. 2 and 3, FIGS. 5A and 5B are end and top views of the partitioning showing a first transfer phase of a load of laundry between two compartments.
Figure 7A:
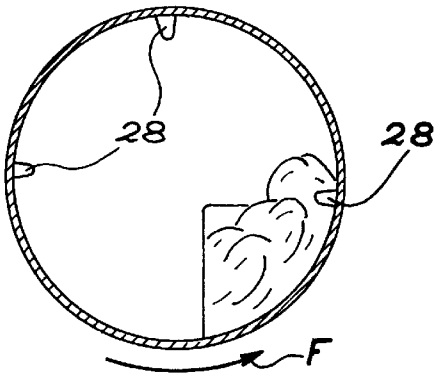
FIGS. 7A and 7B are similar views to 5A and 5B showing a third transfer phase.
Figure 7B:
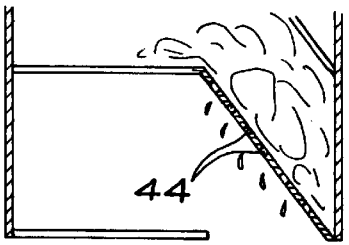
Figure 6A:
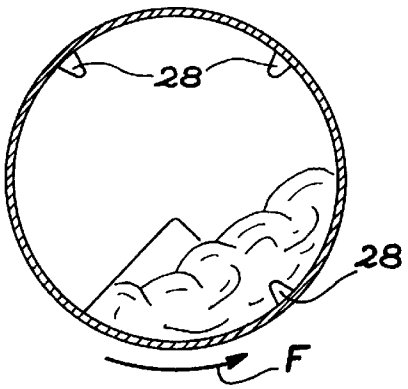
FIGS. 6A and 6B are similar views to 5A and 5B showing a second transfer phase.
Figure 6B:
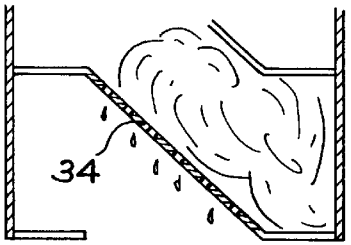

As can be seen from FIG. 4, flanges 28 are provided inside circumferential wall 17 of the drum 16 in order to increase agitation of the laundry using known techniques.

A detailed description of the partitioning means installed inside drum 16 will now be given with reference to FIGS. 2 to 4.

The partitioning means comprise a flat partition 30 separating each pair of adjacent compartments 26. Each partition 30 is radially oriented around the axis of drum 16 and has the shape of a disk whose peripheral edge is welded to the interior of circumferential wall 17.

All the partitions 30 comprise an off-center opening 32 that has the approximate shape of a circular sector. This off-center opening 32 is formed between the axis of drum 16 and its circumferential wall 17 such that it is oriented upwards when the drum is in its median rest position in relation to the laundry agitation caused by the alternate rotation of the drum caused by geared motor 18. If the alternate rotation o the drum is through 270°, the amplitude will therefore be 135° either side of this median position.

Figure 2:
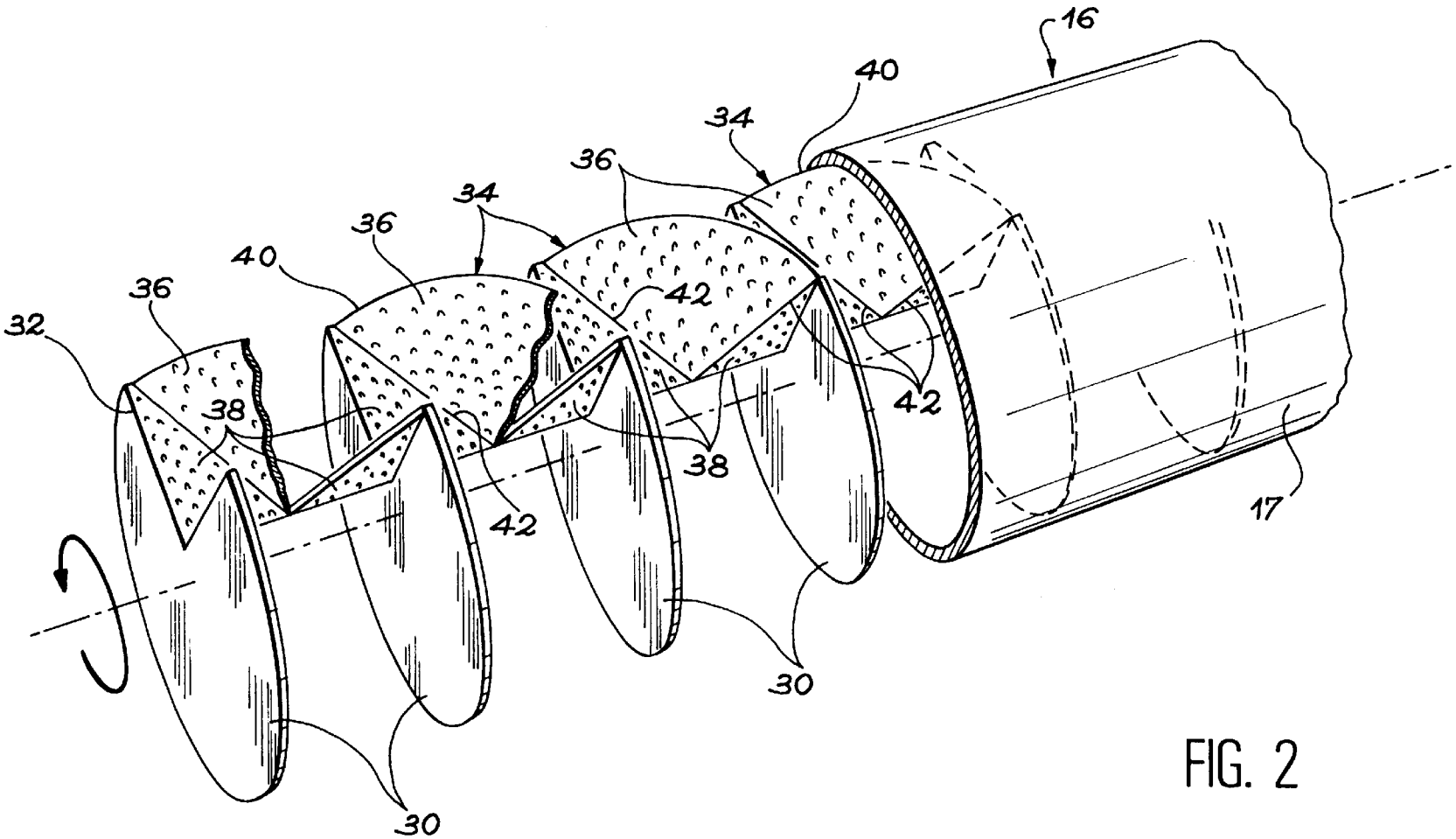
FIG. 2 is a perspective view showing part of the inner partitioning of the washing tunnel drum of FIG. 1 according to a first embodiment of the invention.

As can be seen particularly clearly from FIGS. 2 and 4, the circular sector formed by the opening 32 cut into each partition 30 is at an angle of approximately 90° and its peak is offset in relation to the axis of drum 16, i.e. the top in the median position of the drum.

Figure 5A:
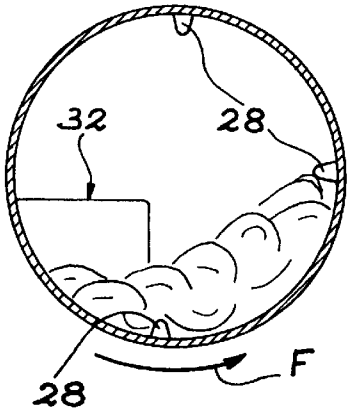
Figure 5B:
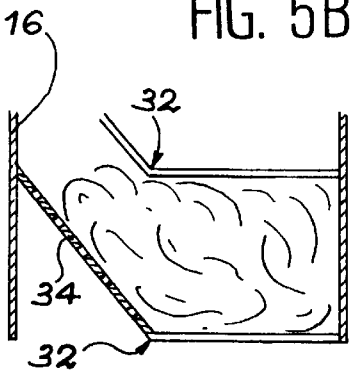

As can be seen particularly clearly from FIGS. 5A, 5B and 5C, one of the flanges 28 is advantageously positioned in the drum 16 more or less in line with the leading edge of each opening 32 in relation to the direction of rotation of the drum (arrow F).

In addition to the partitions 30 separating adjacent compartments 26, the partitioning means provided inside drum 16 also comprise transfer blades 34 that interconnect the openings 32 of adjacent partitions 30 inside each compartment 26. These blades 34 are designed automatically to transfer laundry from one compartment 26 to the next when drum 16 makes a complete revolution, for example when driven by geared motors 18 and 20.

More precisely, inside each compartment 26 a transfer blade 34 connects the opposing sides of the circular sectors formed by the openings 32 that give into the compartment in question. Each transfer blade 34 is constructed of more or less flat components and has the approximate shape of a helix.

In the two embodiments shown in FIGS. 2 to 8, the transfer blades 34 are constructed of pieces of sheet metal that are more or less flat, folded or welded to one another and to partitions 30 as well as to the circumferential wall 17 of drum 16 along straight lines or arcs of a circle. This arrangement has the advantage of being suitable for cheap automated production of the drum, thereby limiting the overall cost of the washing tunnel.

In the first embodiment therefore, as shown particularly in FIG. 2, each transfer blade 34 comprises an intermediate section 36 that is more or less flat together with two triangular end-pieces 38 that are also more or less flat.

The more or less flat intermediate section 36 has the shape of a circular sector that has an edge 40 that is an arc of a circle connected by welding to the circumferential wall 17 of drum 16 and joining two successive partitions 30. Intermediate section 36 also has two straight edges 42 that are aligned with the opposing straight sides of the circular sectors formed by openings 32 when seen parallel to the axis of the drum, i.e. when the drum is viewed from the end.

Each triangular end-piece 38 of transfer blades 34 connects the straight edges 42 of the intermediate section 36 of said blade to the opposing straight sides of the circular sectors formed by openings 32 that give into the compartment containing the blade. The triangular end-pieces 38 of blades 34 are therefore oriented parallel to the axis of the drum 16 and located in two planes that form an angle identical to that of the openings 32.

Openings 32 cut into the partitions 30 are aligned when drum 16 is seen from the end. All the blades 34 located in the compartments 26 are also identical to ensure the transfer of laundry in the same direction between the compartments 26 when the drum 16 makes a complete revolution driven by geared motors 18 and 20. The blades 34 located in the first and last compartments 26 fitted with hopper 22 and chute 24 may have different shapes to ensure correct transfer of the laundry when the drum 16 makes a complete revolution.

Figure 3:
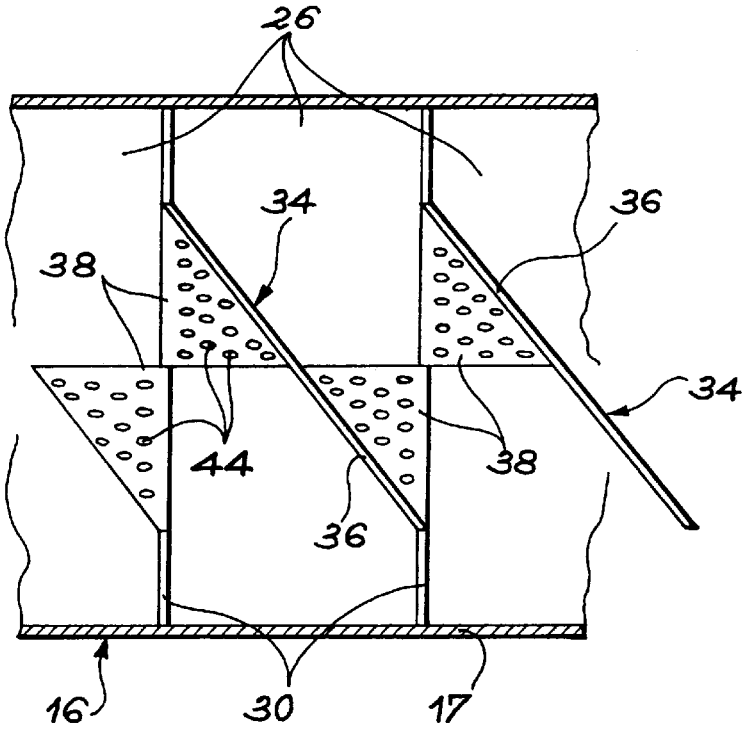
FIG. 3 is a top view of the partitioning shown in FIG. 2.

A can be seen in FIGS. 3 and 4, the blades 34 in some compartments may include perforations 44. These perforations ensure that the laundry is drained as is passed from one compartment 26 to another.

As is standard in washing tunnels, the partitions 30 are also perforated (not shown) where they separate two compartments 26 having the same function.

As has already been pointed out, the internal partitioning structure of drum 16 described above with reference to FIGS. 2 to 4 ensures that the cost of producing the washing tunnel is appreciably reduced due to the possibility of producing the drum using automated techniques.

This type of partitioning also avoids the danger of jamming between adjacent compartments. Consequently in the event of accidental introduction of two loads of laundry into the same compartment there is no risk of jamming between compartments; this type of incident therefore has no negative consequences for the user.

Moreover, the design of the partitioning means described above ensures washing quality comparable with that of an Archimedes screw type washing tunnel for a drum of given diameter. The dropping height of the invention uses approximately ⅔ of the diameter of the drum as in Archimedes screw type washing tunnels.

The use of perforated blades 34 drains the laundry as it is transferred from one compartment 26 to the next as seen in FIGS. 5A, 5B, 6A, 6B, 7A and 7B. The washing quality is improved compared with that of Archimedes screw type washing tunnels that do not have this type of perforation.

Figure 8:
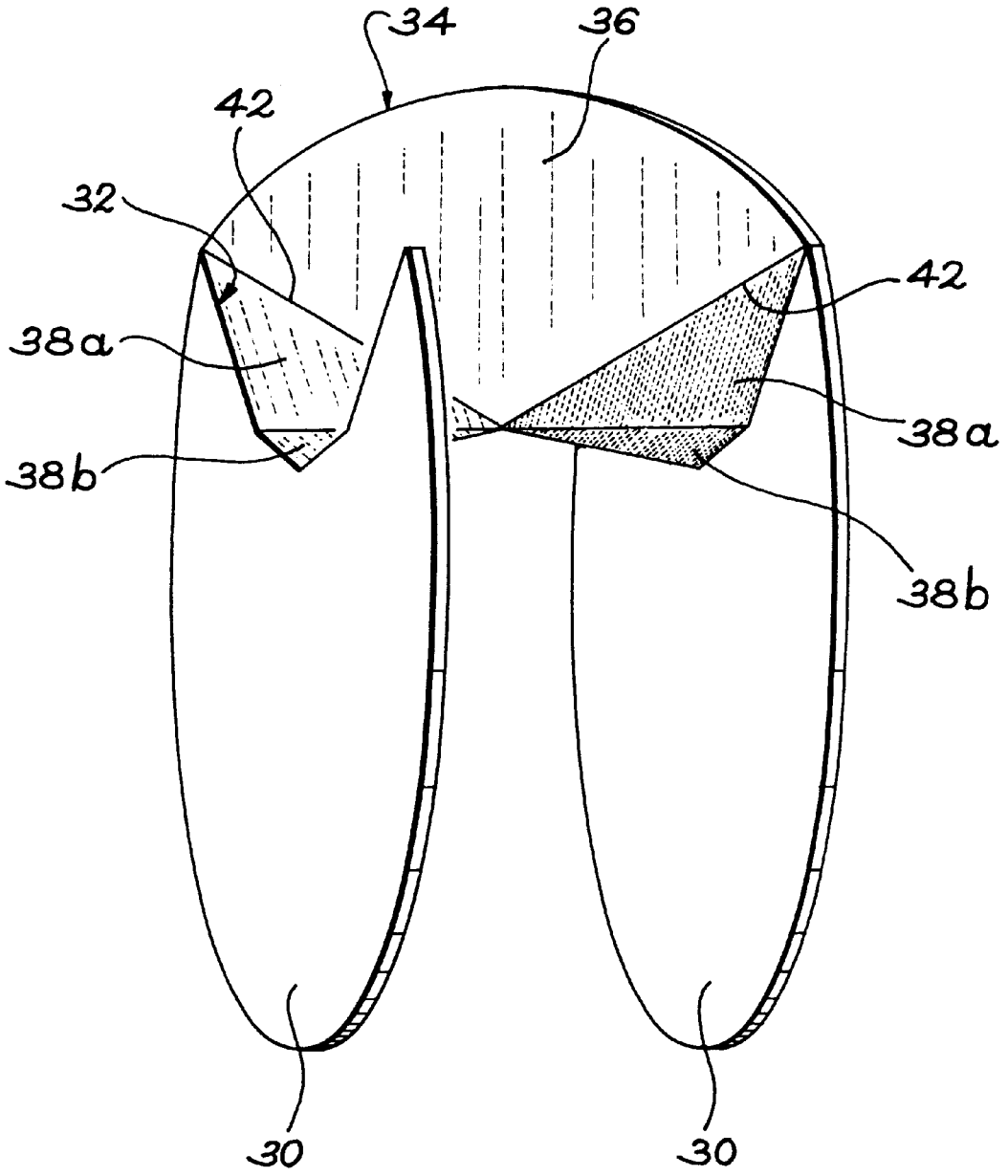
FIG. 8 is a perspective view comparable to FIG. 2 showing a preferred embodiment of the partitioning.

In the second preferred embodiment of the invention illustrated in FIG. 8 the blades 34 and the openings 32 are of slightly different shapes that improve the transfer of laundry between the compartments.

The sides of the circular sectors formed by the openings 32 are not straight; instead each consists of two consecutive segments that together form an obtuse angle turned towards the opening.

Moreover, although each blade 34 still has a flat intermediate section 36 in the shape of a circular sector, the end pieces connecting the straight edges 42 of the intermediate section 36 to the opposing sides of openings 32 are different. Each end piece in this embodiment is formed from two flat components 38*a* and 38*b* that are triangular and non-coplanar.

More precisely, when the drum is viewed along its axis the peak of the circular sector formed by intermediate section 36 is offset on the side of the opening 32 in relation to the peak of the circular sector formed by the opening. The flat component 38*a* connects a straight edge 42 of the circular sector formed by intermediate section 36 to the external segment of a side of the circular sector formed by opening 32. In addition, flat component 38*b* connects the third side of the flat components 38*a* to the internal segment of a side of the circular sector formed by opening 32.

This arrangement makes it possible for the blades 34 to have a shape very close to that of a portion of a helix while being very easily constructed out of folded, soldered sheet metal.

It should be noted that the number of flat components forming the ends of the blades may be more than two.

It is clear that the washing tunnel of the invention may be modified in various ways without leaving the framework of the invention. In particular the washing tunnel of the invention may be fitted with all the improvements and facilities available on comparable machines.

I claim:

1. A washing tunnel comprising a drum adapted to rotate about a substantially horizontal axis, said drum having a first end adapted to receive laundry to be washed and a second end adapted to remove washed laundry, substantially flat partitions dividing the drum into a plurality of successive compartments located between the first and second ends for carrying out prewashing, washing and rinsing operations, each partition comprising an off-center opening formed between the axis and the circumferential wall of the drum, a transfer blade being located in each compartment between the openings formed in the partitions, so as to ensure an automatic transfer of the laundry between the compartments during a complete revolution of the drum, wherein the off-center openings are oriented upwards in a median position of the drum during an agitation of the laundry caused by alternate rotation of the drum by less than one turn, each transfer blade being formed of at least three substantially flat components.

2. Washing tunnel of claim 1 wherein each transfer blade has substantially the shape of part of a helix.

3. Washing tunnel of claim 1 wherein each partition is oriented radially in relation to the axis of the drum and the opening has substantially the shape of a circular sector cut into the partition.

4. Washing tunnel comprising a drum adapted to rotate about a substantially horizontal axis, said drum having a first end adapted to receive laundry to be washed and a second end adapted to remove washed laundry, flat partitions dividing the drum into a plurality of successive compartments located between the first and the second ends for carrying out prewashing, washing and rinsing operations, each partition comprising an off-center opening formed between the axis and the circumferential wall of the drum, a transfer blade being located in each compartment, between the openings formed in the partitions, so as to ensure the automatic transfer of the laundry between the compartments during a complete revolution of the drum, wherein the off-center openings are oriented upwards in a median position of the drum during an agitation of the laundry caused by alternate rotation of the drum by less than one turn, each transfer blade being formed of substantially flat components, wherein each partition is oriented radially in relation to the axis of the drum and the opening has substantially the shape of a circular sector cut into the partition, and wherein the circular sector formed by the opening is at an angle that is noticeably offset from the axis on the opening side.

5. Washing tunnel of claim 3 wherein each transfer blade connects opposite sides of circular sectors cut into the partitions that define the compartment containing the blade.

6. Washing tunnel comprising a drum adapted to rotate about a substantially horizontal axis, said drum having a first end adapted to receive laundry to be washed and a second end adapted to remove washed laundry, flat partitions dividing the drum into a plurality of successive compartments located between the first and the second ends for carrying out prewashing, washing and rinsing operations, each partition comprising an off-center opening formed between the axis and the circumferential wall of the drum, a transfer blade being located in each compartment between the openings formed in the partitions so as to ensure the automatic transfer of the laundry between the compartments during a complete revolution of the drum, in which the off-center openings are oriented upwards in a median position of the drum during an agitation of the laundry caused by alternate rotation of the drum by less than one turn, each transfer blade being formed of substantially flat components, wherein each partition is oriented radially in relation to the axis of the drum and the opening has more or less the shape of a circular sector cut into the partition, and wherein each transfer blade comprises:

substantially less flat intermediate section in the shape of a circular sector that has an edge that is an arc of a circle connected to the circumferential wall of the drum and connecting two consecutive partitions, and two straight edges that are substantially aligned with the opposing sides of the circular sectors formed by the openings, parallel to the said axis, two triangular end-pieces that are substantially flat and connect the straight edges of the intermediate section to the opposing sides of the circular sectors formed by the openings that give into the compartment in question.

7. Washing tunnel comprising a drum adapted to rotate about a substantially horizontal axis, said drum having a first end adapted to receive laundry to be washed and a second end adapted to remove washed laundry, flat partitions dividing the drum into a plurality of successive compartments located between the first and the second ends for carrying out prewashing, washing and rinsing operations, each partition comprising an off-center opening formed between the axis and the circumferential wall of the drum, a transfer blade being located in each compartment, between the openings formed in the partitions, so as to ensure an automatic transfer of the laundry between the compartments during a complete revolution of the drum, wherein the off-center openings are oriented upwards in a median position of the drum during an agitation of the laundry caused by alternate rotation of the drum by less than one turn, each transfer blade being formed of substantially flat components, wherein each partition is oriented radially in relation to the axis of the drum and the opening has more or less the shape of a circular sector cut into a partition, and wherein each transfer blade comprises:

a substantially flat intermediate section in the shape of a circular sector that has an edge that is an arc of a circle connected to the circumferential wall of the drum and connecting two consecutive partitions, and two straight edges that are substantially aligned with the opposing sides of the circular sectors formed by the openings, parallel to the said axis, two end-pieces, each constructed from at least two flat components that are substantially triangular and non-coplanar and connect the straight edges of the intermediate section to the opposing of the circular sectors formed by the openings that give into the compartment in which the blade is housed.

8. Washing tunnel of claim 1 wherein the transfer blades are perforated.

9. A washing tunnel comprising a drum adapted to rotate about a substantially horizontal axis, said drum having a first end adapted to receive laundry to be washed and a second end adapted to remove washed laundry, flat partitions dividing the drum into a plurality of successive compartments located between the first and the second ends for carrying out prewashing and rinsing operations, each partition comprising an off-center opening formed between the axis and the circumferential wall of the drum, a transfer blade being located in each compartment, between the openings formed in the partitions, so as to ensure an automatic transfer of the laundry between the compartments during a complete revolution of the drum, wherein the off-center openings are oriented upwards in a median position of the drum during an agitation of the laundry caused alternate rotation of the drum by less than one turn, each transfer blade being formed of at least three substantially flat sections, including an intermediate section in the shape of a circular sector and at least two triangular end sections.

10. A washing tunnel comprising a drum adapted to rotate about a substantially horizontal axis, said drum having a first end adapted to receive laundry to be washed and a second end adapted to remove washed laundry, flat partitions dividing the drum into a plurality of successive compartments located between the first and the second ends for carrying out prewashing, washing and rinsing operations, each partition comprising an off-center opening formed between the axis and the circumferential wall of the drum, a transfer blade being located in each compartment between the openings formed of the partitions, so as to ensure an automatic transfer of the laundry between the compartments during a complete revolution of the drum, wherein the off-center openings are oriented upwards in a median position of the drum during an agitation of the laundry caused by alternate rotation of the drum by less than one turn, each transfer blade being formed of at least three non-coplanar flat components connected one to the other along straight edges.

* * * * *